United States Patent [19]

Goel

[11] 4,025,182

[45] May 24, 1977

[54] TRANSFER APPARATUS FOR A COLOR ELECTROPHOTOGRAPHIC PRINTING MACHINE

[75] Inventor: Narendra S. Goel, Henrietta, N.Y.

[73] Assignee: Xerox Corporation, Stamford, Conn.

[22] Filed: Nov. 30, 1973

[21] Appl. No.: 420,747

[52] U.S. Cl. ..... 355/4; 101/186; 101/250; 101/470; 101/DIG. 13

[51] Int. Cl.[2] ..... G03G 15/22

[58] Field of Search ... 101/173, 186, 250, 382 MV, 101/470, DIG. 13; 355/4

[56] References Cited

UNITED STATES PATENTS

| | | | |
|---|---|---|---|
| 246,884 | 9/1881 | Holmes | 101/186 |
| 2,885,955 | 5/1959 | Vyverberg | 101/DIG. 13 |
| 3,531,195 | 9/1970 | Tanaka et al. | 355/4 |
| 3,644,034 | 2/1972 | Nelson | 355/4 X |
| 3,694,069 | 9/1972 | Yamaji et al. | 355/4 |

*Primary Examiner*—Edgar S. Burr
*Assistant Examiner*—William Pieprz
*Attorney, Agent, or Firm*—J. J. Ralabate; H. Fleischer; C. A. Green

[57] ABSTRACT

An apparatus in which successive layers of charged particles are transferred, in superimposed registration with one another, to a sheet of support material. The sheet of support material is reciprocated so that successive forward movements thereof are in synchronism with the movement of the charged particles. On the return movement, the sheet of support material is located in a position to initiate the transfer of the next successive layer of particles in superimposed registration with the previously transferred layer of charge particles during the forward movement thereof.

8 Claims, 2 Drawing Figures

TRANSFER APPARATUS FOR A COLOR ELECTROPHOTOGRAPHIC PRINTING MACHINE

BACKGROUND OF THE INVENTION

This invention relates to an electrostatographic printing machine, and more particularly concerns an improved transfer system for use therein.

In electrostatographic printing, an electrostatic latent charge pattern is created and reproduced in viewable form. The field of electrostatography includes electrophotography and electrography. Electrophotography employs a photosensitive medium to form, with the aid of electromagnetic radiation, an electrostatic latent charge pattern. Contrawise, electrography utilizes an insulating medium to form, without the aid of electromagnetic radiation, the electrostatic latent charge pattern. The process of transferring toner particles deposited on the electrostatic latent charge pattern, in image configuration, to a sheet of support material, is employed in both of the preceding types of electrostatographic printing.

Hereinafter, a color electrophotographic printing machine will be described as an illustrative embodiment of the foregoing process wherein the transfer apparatus of the present invention may be employed. In the process of electrophotographic printing, for example as disclosed in U.S. Pat. No. 2,297,691 issued to Carlson in 1942, an image bearing member or photosensitive element having a photoconductive insulating layer is charged to a substantially uniform potential in order to sensitize the surface thereof. Thereafter, the charged photoconductive surface is exposed to a light image of an original document. As a consequence of the exposure, the charge is selectively dissipated in the irradiated areas in accordance with the light intensity projected onto the charged photoconductive surface. This records an electrostatic latent charge pattern or an electrostatic latent image corresponding to the original document. Development of the electrostatic latent image is achieved by bringing a developer mix into contact therewith. Typical developer mixes employ colored thermoplastic particles, i.e., toner particles, which are mixed with ferromagnetic granules, i.e., carrier granules. The developer mix is selected such that the toner particles acquire the appropriate charge relative to the electrostatic latent image recorded on the photoconductive surface. As the developer mix is moved into contact with the photoconductive surface, the greater attractive force of the electrostatic latent image recorded thereon causes the toner particles to be separated from the carrier granules and adhere to the electrostatic latent image. Thereafter, the toner powder image adhering to the electrostatic latent image is transferred to a sheet of support material such as a sheet of paper, or a thermoplastic sheet amongst others. The toner powder image is then permanently affixed thereto.

One type of transfer apparatus is described in U.S. Pat. No. 3,357,325 issued to Eichorn et al. in 1967. As disclosed therein, a transfer corona generating device is disposed beneath an endless belt arranged to move a sheet of support material into contact with the photoconductive drum. The transfer corona generating device applies a charge to the back of the belt. The electrostatic charge placed on the back of the belt by the corona generating device attracts the powder image from the drum surface to the sheet of support material.

With the advent of multi-color electrophotographic printing, successive layers of toner powder images are transferred to the sheet of support material in superimposed registration with one another. In multi-color electrophotographic printing, successive single color electrostatic latent images are created on the photoconductive surface and developed with correspondingly colored toner particles. Thereafter, each single color toner powder image is transferred to the sheet of support material in superimposed registration with the prior one. Thus, it is evident that the sheet of support material moves in a recirculating path to receive successive toner powder images in superimposed registration with one another. This may be achieved by the employment of a transfer roll. The transfer roll is electrically biased to generate a high voltage discharge in the proximity of the surface of the sheet of support material or it may be applied by means of a conductive cylinder in contact with the paper as is disclosed in U.S. Pat. No. 2,807,233 issued to Fitch in 1957. As described therein, a sheet of support material is interposed between the conductive roller and a surface having the toner powder image thereon. A charge of opposite polarity from the toner particles is deposited on the back side of the sheet of support material which attracts the toner powder image thereto. U.S. Pat. No. 3,612,677 issued to Langdon et al. in 1971 also describes an electrically biased transfer roll. This system is particularly adapted for multi-color electrophotographic printing. As disclosed therein, a transfer roll moves the sheet of support material in a recirculating path. The transfer roll is biased electrically to a potential of sufficient magnitude and polarity to attract electrostatically toner particles from the electrostatic latent image recorded on the photoconductive surface to the sheet of support material. The transfer roll rotates in synchronism with the photoconductive drum. Inasmuch as the sheet of support material is secured releasably on the transfer roll for movement in a recirculating path therewith, successive toner powder images may be transferred thereto in superimposed registration with one another. It should be noted that a transfer roll requires some mechanism for securing the sheet of support material to the transfer roll. This is frequently accomplished by employing gripper fingers arranged to grasp the leading edge of the sheet of support material, thereby securing the sheet of support material to the transfer roll. However, an arrangement of this type may cause edge deletion, i.e., copying without a bleed. Moreover, the foregoing type of system is relatively complex and expensive to manufacture. In addition, it requires a change in the paper feed path. Generally, the paper feed path employs a plurality of endless conveyor belts adapted to advance the sheet of support material from the sheet tray to the catch tray for subsequent removal therefrom by the operator. The conveyors transport the sheet of support material sequentially through the respective processing station to produce the desired copy thereon. However, with the employment of a transfer roll, this simple feed path is interrupted and additional complexities are added to the system. Thus, it would be highly desirable to employ a flat surface or endless conveyor belt in lieu of the transfer roll when creating multi-color copies.

Accordingly, it is a primary object of the present invention to improve the apparatus for transferring toner powder images from a photoconductive surface to a sheet of support material.

SUMMARY OF THE INVENTION

Briefly stated, and in accordance with the present invention, there is provided an apparatus for transferring at least two successive layers of charged particles from a movable particle bearing member to a sheet of support material, in superimposed registration with one another.

Pursuant to the present invention, there is provided a support member having a generally planar surface for securing releasably thereto the sheet of support material. The support member is operatively associated with the movable particle bearing member, being arranged for reciprocating movement to effect the transfer of successive layers of charge particles from the particle bearing member to the sheet of support material in superimposed registration with one another. Means are provided for reciprocating the support member so that the forward movement thereof is in synchronism with the movement of the particle bearing member, thereby transferring the charged particles thereon to the sheet of support material. The return movement of the support member locates it in a position to initiate the transfer of the next successive layer of charged particles. In this manner, successive layers of charged particles are transferrred from the particle bearing member to the sheet of support material, in superimposed registration with one another.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
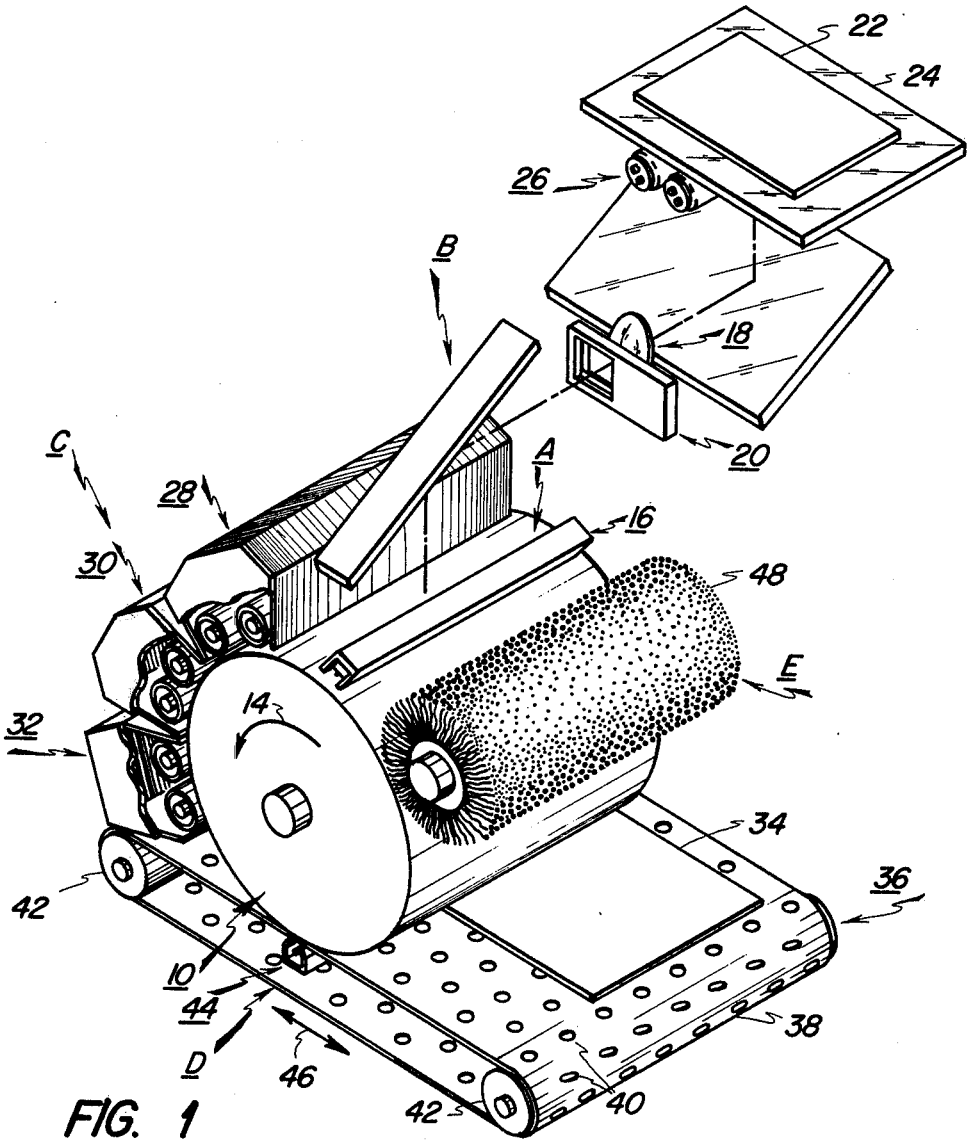
FIG. 1 is a schematic perspective view of a color electrophotographic printing machine incorporating the features of the present invention therein.

For a general understanding of the disclosed electrophotographic printing machine in which the present invention may be incorporated, continued reference is had to the drawings, wherein like reference numerals have been used throughout to designate like elements. FIG. 1 schematically illustrates the various components of a printing machine adapted to produce color copies from a colored original document. Although the transfer apparatus of the present invention is particularly well adapted for use in a color electrophotographic printing machine, it should become evident from the following discussion that it is equally well suited for use in a wide variety of electrostatographic printing machines and is not necessarily limited in its application to the particular embodiment shown herein.

As shown in FIG. 1, the printing machine employs an image or particle bearing member having a drum 10 with a photoconductive surface 12 secured to and entrained about the exterior circumferential surface thereof. Drum 10 is mounted rotatably within the machine frame (not shown) and moves in the direction of arrow 14. Preferably, photoconductive surface 12 has a relatively panchromatic response to white light. One type of suitable photoconductive material is disclosed in U.S. Pat. No. 3,655,377 issued to Sechak in 1972. A series of processing stations are located such that as drum 10 rotates in the direction of arrow 14 it passes sequentially therethrough. Drum 10 is driven at a predetermined speed by a drive motor (not shown) relative to the various machine operating mechanisms. A timing disc having a plurality of spaced slits in the periphery thereof is mounted on the shaft of drum 10 and rotates in synchronism therewith. A light source develops light rays which pass through the slits in the timing disc and are detected by a photosensor. The signal from the photosensor triggers the machine logic to coordinate the operations at each station producing the proper sequence of events thereat. Thus, the machine logic in association with the timing disc actuates the operating mechanism of the printing machine to create a multi-color copy from the colored original document.

Initially, drum 10 advances photoconductive surface 12 through charging station A. Charging station A has positioned thereat a corona generating device indicated generally at 16. Corona generating device 16 extends in a generally transverse direction across photoconductive surface 12. This readily enables corona generating device 16 to charge photoconductive surface 12 to a relatively high substantially uniform potential. The foregoing type of corona generating device is, preferably, of the type described in U.S. Pat. No. 2,778,946 issued to Mayo in 1957.

Thereafter, drum 10 rotates to exposure station B where a color filtered light image of the original document is projected onto charged photoconductive surface 12. Exposure station B includes thereat a moving lens system, generally designated by the reference numeral 18, and a color filter mechanism shown generally at 20. A suitable moving lens system is disclosed in U.S. Pat. No. 3,062,108 issued to Mayo in 1962. As shown in FIG. 1, an original document 22, such as a sheet of paper, book or the like is placed face down upon transparent viewing platen 24. Lamp assembly 26, filter mechanism 20 and lens 18 move in a timed relationship with drum 10 to scan successive incremental areas of original document 22 disposed upon platen 24. This scanning operation creates a flowing light image of original document 22 which irradiates charged photoconductive surface 12. Filter mechanism 20 is adapted to interpose select color filters into the optical light path. The appropriate color filter operates on the light rays transmitted through lens 18 to record an electrostatic latent image on photoconductive surface 12 corresponding to a preselected spectral region of the electromagnetic wave spectrum, hereinafter referred to as a single color electrostatic latent image.

After exposure, drum 10 rotates the single color electrostatic latent image recorded on photoconductive surface 12 to development station C. Development station C includes three individual developer units, generally indicated by the reference numerals 28, 30 and 32, respectively. A suitable development station employing a plurality of developer units is disclosed in co-pending application Ser. No. 255,259 filed in 1972. Preferably, the developer units are all of a type referred to generally as magnetic brush developer units. A typical magnetic brush developer unit employs a magnetizable developer mix having carrier granules and toner particles therein. The developer mix is continually brought through a directional flux field to form a brush thereof. The single color electrostatic latent image recorded on photoconductive surface 12 is developed by bringing the brush of developer mix into contact therewith. Each of the respective developer units contain discretely colored toner particles corresponding to the complement of the spectral region of the wave length of light transmitted through filter 20. For example, a green filtered electrostatic latent image is rendered visible by depositing green absorbing magenta toner particles thereon. Similarly, blue and red latent images are developed with yellow and cyan toner particles, respectively.

Drum 10 is next rotated to transfer station D where the toner powder image adhering electrostatically to photoconductive surface 12 is transferred to a sheet of support material 34. Transfer station D includes the transfer apparatus of the present invention, designated generally by the reference numeral 36. Transfer apparatus 36 is characterized by an endless belt 38 having a plurality of apertures 40 therein. Endless belt 38 is entrained about a pair of spaced rollers 42. Corona generator 44 is disposed beneath endless belt 38 in the nip defined by drum 10 and belt 38. In this manner, corona generating device 44 produces a spray of ions which pass through belt 38 and charge the back side of support material 34 to the proper polarity and magnitude for attracting the toner particles from the electrostatic latent image recorded on photoconductive surface 12 to support material 34. Endless belt 38 is adapted to be reciprocated so that successive layers of toner particles may be transferred to support material 34 in superimposed registration with one another. Transfer apparatus 36 will be described hereinafter in greater detail with reference to FIG. 2.

Referring now to the sheet feeding path, support material 34 is advanced from a stack thereof. A feed roll, in operative communication with a retard roll, advances and separates the uppermost sheet from the stack. The advancing sheet moves into a chute which directs it onto endless belt 38. Support material 34 is releasably secured to endless belt 38. This may be achieved by electrostatically attracting support material 34 to endless belt 38 with a precharging corona generating device or a roller, or by mechanically tacking it to the belt. Mechanical tacking can be achieved by using one of a great variety of devices. For example, gripper fingers, puffers or an endless belt having a plurality of apertures therein with a vacuum therebehind, is described in FIGS. 1 and 2. As the sheet of support material passes through transfer station D, the transfer of the toner powder image from photoconductive surface 12 to support material 34 occurs due to the applied electrostatic field. After a plurality of successive toner powder images have been transferred to support material 34, the support material is separated from endless belt 38 and advanced to the fixing station (not shown).

Figure 2:
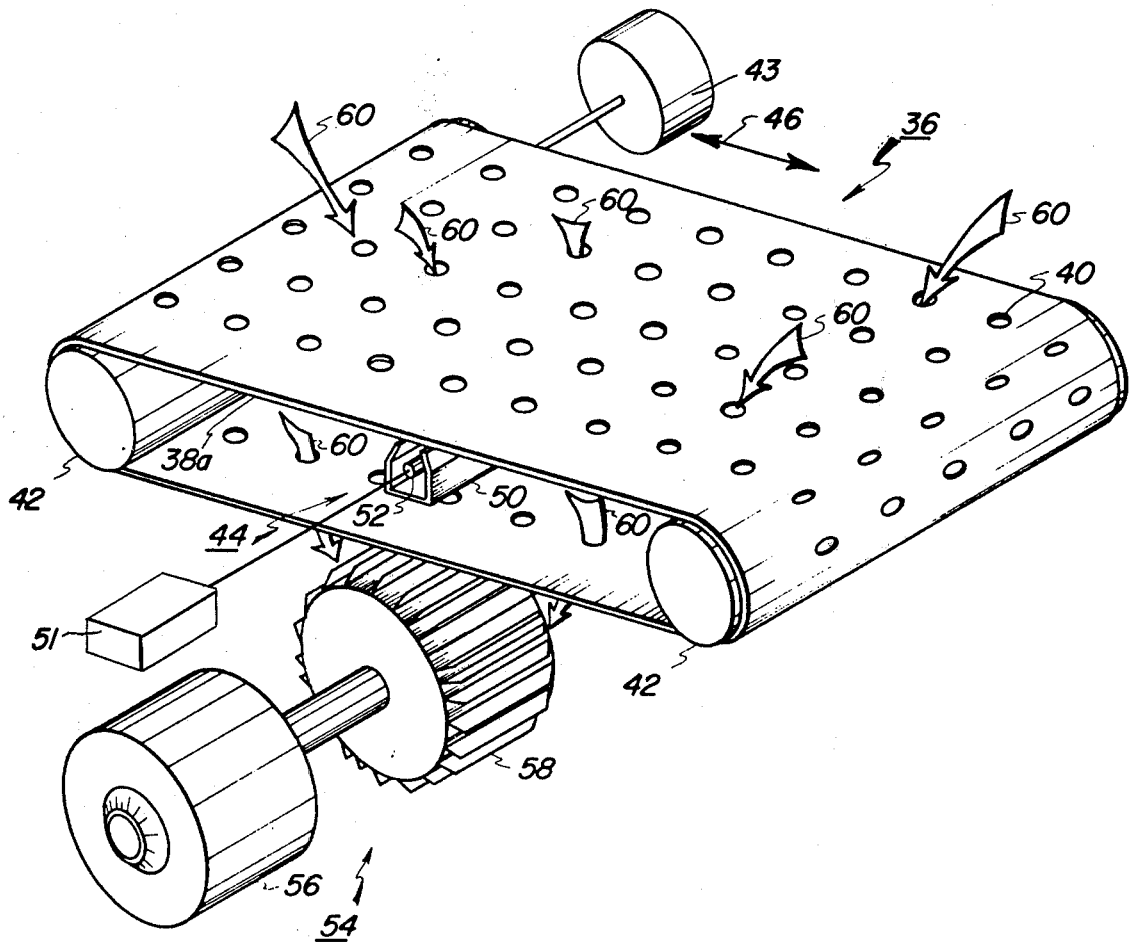
FIG. 2 is a schematic perspective view of the transfer apparatus employed in the FIG. 1 printing machine.

While the transfer apparatus of the present invention has been described as employing a corona generating device of the type shown in FIGS. 1 and 2, it will be obvious to one skilled in the art that many variations may be employed. For example, one or a plurality of electrically biased transfer rolls may be positioned beneath the belt surface to produce the electrostatic field for transferring toner particles from the photoconductive surface to the sheet of support material.

An alternate embodiment of the present invention positions the corona generating device illustrated in FIGS. 1 and 2 above the sheet of support material. In this embodiment, the conora generating device is energized to produce a spray of ions of the proper polarity to have the toner particles attracted from the photoconductive surface to the sheet of support material.

At the fixing station, a fuser applies sufficient heat to permanently affix the multi-layered toner powder image to support material 34. One type of suitable fuser is described in U.S. Pat. No. 3,498,592 issued to Moser et al. in 1970. After the fusing process, support material 34 with the toner powder image affixed permanently thereto is advanced by a plurality of endless belt conveyors (not shown) to a catch tray (not shown) for subsequent removal from the printing machine by the operator.

Although a preponderance of the toner particles are transferred to support material 34, invariably some residual toner particles remain on photoconductive surface 12 after the transfer of the toner powder image therefrom. These residual toner particles are removed from photoconductive surface 12 as it passes through cleaning station E. Here the residual toner particles are initially brought under the influence of a cleaning corona generating device (not shown) adapted to neutralize the electrostatic charge on the toner particles and photoconductive surface 12. Toner particles are then cleaned from photoconductive surface 12 by a rotatably mounted fibrous brush 48 in contact therewith. A suitable brush cleaning device is described in U.S. Pat. No. 3,590,412 issued to Gerbasi in 1971. In this manner, residual toner particles remaining on photoconductive surface 12 after each transfer operation are readily removed therefrom.

It is believed that the foregoing description is sufficient for purposes of the present application to depict the general operation of the color electrophotographic printing machine embodying the teaching of the present invention therein.

Referring now to the specific subject matter of the present invention, FIG. 2 depicts transfer apparatus 36 associated with photoconductive surface 12 of drum 10. Transfer apparatus 36 includes an endless belt 38 having a plurality of apertures 40 therein. Endless belt 38 is entrained about a pair of spaced opposed substantially parallel rollers 42. At least one roller 42 is driven by an oscillating motor 43 first in one direction then the other direction to reciprocate endless belt 38 in the direction of arrow 46. The reciprocating movement of endless belt 46 is keyed to the machine logic. Thus, when the first toner powder image is deposited on the electrostatic latent image recorded on photoconductive surface 12, the timing disc on drum 10 actuates roller 42 to advance endless belt 38 in the forward direction such that support material 34 situated releasably thereon moves in synchronism with drum 10. This enables the toner powder image on photoconductive surface 12 to be transferred to support material 34. It should be noted that the tangential velocity of drum 10 is the same as the forward linear velocity of endless belt 38. Thereafter, the timing disc triggers the machine logic so that endless belt 38 is moved in the return direction preparatory for receiving the next successive layer of toner particles in superimposed registration with the previously transferred layer of toner particles on support material 34. In this manner, successive layers of toner particles may be transferred to support material 34 in superimposed registration with one another. Preferably, endless belt 38 is made from a 5 mil thick Mylar belt.

Corona generating device 44 is disposed beneath the upper surface 38*a* of endless belt 38. Corona generating device 44 includes an elongated shield 50 preferably made from a conductive material such as an aluminum extrusion. Elongated shield 50 is substantially U-shaped and may be grounded or, in lieu thereof, biased to a suitable electrical voltage level. A discharge electrode 52 is mounted in the chamber defined by U-shaped shield 50. Discharge electrode 52 is, preferably, a coronode wire approximately 0.0035 inches in diameter and extends longitudinally along the length of shield 50. Coronode wire 52 is made preferably from platinum and is excited to produce a flow of ions therefrom. The ion flow is sprayed on the back side of support material 34, thereby causing the toner particles to be electrostatically transferred from photoconductive surface 12 to support material 34. Coronode wire 52 is generally excited by power supply 51 to preferably about 4000 volts, though this voltage may be adjusted suitably to effect good transfer through successive layers of toner powder images deposited on support material 34. Endless belt 38 contains a plurality of apertures of holes 40 therein through which a vacuum can be imposed on support material 34 to prevent it from slipping. Vacuum applying means 54 includes a motor 56 driving a vaned member 58 mounted thereon. Motor 56 is adapted to rotate vaned member 58 such that air flows in the direction of arrows 60, thereby creating a vacuum which tacks support material 34 to endless belt 38. Baffles (not shown) are employed to direct the air flow around corona generating device 44. In this manner, corona generating device 44 is isolated from the air flow and the flow of ions toward the back surface of the sheet of support material is not opposed by the air flow in the direction of arrows 60. Thus, it is evident that successive single color toner powder images may be transferred to support material 34 from photoconductive surface 12 is superimposed registration with one another via the utilization of the transfer apparatus of the present invention.

As hereinbefore described, support material 34 is advanced to endless belt 38. Endless belt 38 moves support material 34 in the forward direction at the same linear velocity as the tangential velocity of drum 10 to enable the first color toner powder image to be transferred thereto. Transfer is effected by spraying ions onto the back surface of support material 34. The ion spray is achieved by a corona generating device suitably excited to produce ions having the proper magnitude and polarity to attract toner particles from photoconductive surface 12 to support material 34. After the first layer of toner particles has been transferred to support material 34, endless belt 34 is moved in the return direction to its initial position so that it may once again be advanced in the forward direction in synchronism with drum 10. In this manner, the next successive single color toner powder image may be transferred to support material 34 in superimposed registration with the previously transferred toner powder image. The foregoing cycle of events is repeated a plurality of cycles (in this case three cycles) so that a multi-color toner powder image may be created on support material 34. Thereafter, the timing disc actuates the machine logic to deactuate motor 56 reducing the vacuum holding support material 34 to endless belt 38. This permits the support material to be advanced onto the next successive endless conveyor which moves it into the fusing apparatus. As previously discussed, the fusing apparatus permanently affixes the multi-layered toner powder image to support material 34. The fused toner powder image on the support material is then advanced by a plurality of endless belts to the catch tray where the operator may remove the multicolor copy.

An alternate embodiment of the present invention employs an electrically biased belt in lieu of a belt and corona generating device. There are basically three types of electrically biased belts. These are a dielectric belt, an electrically relaxable belt and a conductive belt. With a dielectric belt, the voltage drop across a belt in any region near the transfer nip is a function of the dielectric constant and the thickness of the belt and not of its resistivity. The conductive belt has a voltage drop across the belt in the transfer nip which is zero. The electrically relaxable belt behaves like a lossy dielectric and the voltage drop across the belt decreases while the belt is moving through the transfer nip. The drop depends on both the bulk resistivity and dielectric thickness of the belt. Various biased belts are described in U.S. Pat. No. 3,647,292 issued to Weikel in 1972, the disclosure of which is hereby incorporated into the present application.

Still another embodiment of the present invention employs substantially the same system as heretofore disclosed with a porous endless belt. In this system, the endless belt comprises an apertured Mylar undercoating having a fibrous mat of non-woven uniformly porous material overlying it. In this manner, the vacuum is drawn through the belt and the corona discharge device sprays ions through the belt onto the back side of the support material to attract toner particles thereto.

In recapitulation, successive color separated electrostatic latent images are formed on a photoconductive surface and sequentially developed by the respective colored toner particles complementing the color separated latent image. The developed toner powder images are transferred in superimposed registration with one another, to the sheet of support material by the transfer apparatus of the present invention. As hereinbefore indicated, the transfer apparatus of the present invention employs a reciprocating belt the movement of which is synchronized with the successive toner powder images deposited on the photo-conductive surface permitting the transfer of the toner powder images to the support material in superimposed registration with one another. After the transfer process, the layers of toner powder are permanently affixed to the support material to form a composite multi-color reproduction on the sheet of support material.

Thus, it is apparent that there has been provided, in accordance with the present invention, a transfer apparatus that fully satisfies the objects, aims and advantages set forth above. While the present invention has been described in conjunction with various specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claim is:

1. An apparatus for transferring at least two successive layers of charged particles from a movable particle bearing member to a sheet of support material in superimposed registration with one another, including:

a porous support member having a generally planar surface for securing releasably thereto the sheet of support material, said support member being positioned closely adjacent to the movable particle bearing member;

means for reciprocating said support member such that the forward movement is in synchronism with the movement of the particle bearing member to transfer the charged particles thereon to the sheet of support material secured releasably to said support member and the return movement locates said support member in position to initiate the transfer of the next successive layer of charged particles from the particle bearing member to the sheet of support material in superimprosed registration with the previously transferred layer of charged particles;

corona generating means positioned closely adjacent to said support member; and means for energizing said corona generating means to spray ions through said support member onto the back surface of the sheet of support material to electrostatically attract the charged particles to the front surface thereof.

2. An apparatus as recited in claim 1, further including means for securing releasably the sheet of support material to said support member.

3. An apparatus as recited in claim 2, wherein said support member includes:

a plurality of rollers; and a porous endless belt entrained about said rollers.

4. An apparatus as recited in claim 3, wherein said securing means includes vacuum applying means for producing an air flow through said endless belt to secure the sheet of support material thereto.

5. An electrostatographic printing machine of the type wherein at least two successive layers of toner particles are transferred to a sheet of support material in superimposed registration with one another, including:

a movable image bearing member having toner particles deposited thereon in image configuration;

a porous support member having a generally planar surface for securing releasably thereto the sheet of support material, said support member being positioned closely adjacent to said movable image bearing member means for reciprocating said support member such that the forward movement is in synchronism with the movement of said image bearing member to transfer the toner particles thereon to the sheet of support material secured releasably to said support member and the return movement locates said support member in position to inititate the transfer of the next successive layer of toner particles from said image bearing member to the sheet of support material in superimposed registration with the previously transferred layer of toner particles;

corona generating means positioned closely adjacent to said support member; and means for energizing said corona generating means to spray ions through said support member onto the back surface of the sheet of support material to electrostatically attract the toner particles to the front surface thereof.

6. A printing machine as recited in claim 5, further including means for securing releasably the sheet of support material to said support member.

7. A printing machine as recited in claim 6, wherein said support member includes:

a plurality of rollers; and a porous endless belt entrained about said rollers.

8. A printing machine as recited in claim 7, wherein said securing means includes vacuum applying means for producing an air flow through said endless belt to secure the sheet of support material thereto.

* * * * *